US005724629A

United States Patent [19]

Iino et al.

[11] Patent Number: 5,724,629

[45] Date of Patent: Mar. 3, 1998

[54] LIQUID DEVELOPER MONITORING DEVICE, LIQUID DEVELOPER CONTROLLING SYSTEM, AND IMAGE FORMING APPARATUS USING SAME

[75] Inventors: Shuji Iino, Muko; Toshimitsu Fujiwara, Kobe; Hidetoshi Miyamoto, Takatsuki; Masami Yamada, Osaka, all of Japan

[73] Assignee: Minolta Co., Ltd., Osaka, Japan

[21] Appl. No.: 671,880

[22] Filed: Jun. 28, 1996

[30] Foreign Application Priority Data

Jun. 28, 1995 [JP] Japan ..... 7-162192

[51] Int. Cl.[6] ..... G03G 15/10

[52] U.S. Cl. ..... 399/57; 399/245; 118/690

[58] Field of Search ..... 355/256; 118/651, 118/659–661, 688, 689, 690; 430/117–119; 399/57, 241, 245

[56] References Cited

U.S. PATENT DOCUMENTS

| | | | |
|---|---|---|---|
| Re. 30,477 | 1/1981 | Gardiner et al. | 118/689 |
| 4,310,238 | 1/1982 | Mochizuki et al. . | |
| 4,860,924 | 8/1989 | Simms et al. . | |
| 5,003,352 | 3/1991 | Duchesne et al. | 355/256 |
| 5,231,454 | 7/1993 | Landa | 355/256 |
| 5,243,391 | 9/1993 | Williams et al. | 355/256 |

*Primary Examiner*—Robert Beatty
*Attorney, Agent, or Firm*—McDermott, Will & Emery

[57] ABSTRACT

This invention relates to a liquid developer monitoring device comprising a first electrode which contacts with a liquid developer comprising a liquid medium and electrically charged toner particles dispersed therein, a second electrode being either a developing roller or a separate roller which provides a fresh surface and immerses said surface in the liquid developer, an electric power source which applies a bias voltage between said first and second electrodes so as to deposit the toner particles on the second electrode, and a sensor which measures magnitude of current flowing between said first and second electrodes during the deposition of the toner particles. A cleaning device removes the deposited toner on the second electrode. The sensor includes an electric coil, a magnet inserted in the coil and a Hall element.

32 Claims, 14 Drawing Sheets

LIQUID DEVELOPER MONITORING DEVICE, LIQUID DEVELOPER CONTROLLING SYSTEM, AND IMAGE FORMING APPARATUS USING SAME

BACKGROUND OF THE INVENTION

This invention relates to a liquid developer monitoring device for monitoring the physical properties of a liquid developer for use as in a wet image forming apparatus such as electrophotographic printer or a copying machine. This invention also relates to a liquid developer controlling system using the liquid developer monitoring device mentioned above. This invention further relates to an image forming apparatus using the liquid developer monitoring device mentioned above.

The electrophotographic process which produces a visible image by developing an electrostatic latent image formed on a photosensitive member with an electrically charged toner is known in two major types, i.e. the dry developing method which directly uses the toner in the form of a powder and the wet developing method (liquid developing method) which uses a developer having the toner dispersed in a liquid medium.

The wet developing method generally develops the electrostatic latent image on the surface of the photosensitive member by immersing the surface of the photosensitive member in the liquid developer. Generally, the wet developing method is capable of producing an image possessing high resolution and excelling in gradient of tone because it is allowed to use a toner of a smaller particle diameter than the toner which is used by the dry developing method. It further has such advantages as permitting easy fixation of the image of toner on a recording medium such as paper.

In recent years, demand for images with increasingly high fineness has been growing. The toner has been consequently urged by this demand toward marked decrease in particle diameter. In the dry developing method, however, the toner developed to date for practical use therefor has an average particle diameter of about 6 μm.

In contrast, the wet developing method uses the toner as dispersed in a liquid medium and consequently permits the toner to have a particle diameter of the order of submicrons, for example, and accordingly enjoys the advantage of vesting images with high quality and high fineness.

Since the liquid developer contains at least a toner and a liquid medium for dispersing the toner, however, it suffers the balance between the toner and the liquid medium therein to be ultimately upset after protracted use thereof and entails the problem of altering the characteristic properties thereof and exerting an adverse effect on the produced images. This trend conspicuously manifests itself particularly when the liquid developer contains a charge controlling agent for controlling the electric charge of the toner.

In the wet developing method, for the purpose of precluding the problem mentioned above and enabling the liquid developer to retain stable properties at all times, therefore, it is necessary to adjust the quantitative balance of such components of the liquid developer as toner, liquid medium, and charge controlling agent by ensuring suitable replenishment of the components. For this reason, U.S. Pat. No. 4,860,924, for example, has disclosed means to control the amounts of the toner and the charge controlling agent in the liquid developer by measuring the transmittance of the liquid developer and the electroconductivity thereof relative to AC and replenishing the toner and the charge controlling agent based on the results of the measurement.

Generally, when an electric current is passed through a liquid developer for the purpose of measuring the electroconductivity of the liquid developer, namely the magnitude of resistance of the liquid developer, the toner is inevitably electrodeposited on electrodes. The liquid developer, therefore, is compelled to manifest a magnitude of current different from the magnitude which the same developer would manifest in the absence of adhesion of the toner to the electrodes. In short, when the electric current is passed through the liquid developer for measuring the magnitude of resistance thereof, the toner is electrodeposited on the electrodes and, as a result, the magnitude of resistance of the liquid developer can no longer be measured accurately. The invention of the U.S. patent specification mentioned above, therefore, contemplates monitoring the magnitude of resistance of a liquid developer while applying an AC electric field meanwhile to the liquid developer so as to preclude the possible adhesion of the toner to the electrodes.

Even when the magnitude of resistance of a liquid developer is measured while an AC electric field is continuously applied thereto, however, the adhesion of toner to the electrodes cannot be completely eliminated. The invention, accordingly, has the problem that the magnitude of resistance (or electroconductivity) cannot be discerned accurately. It also has the problem that the complication of an AC voltage applying circuit and an AC current measuring circuit entrails an addition to the cost of equipment.

SUMMARY OF THE INVENTION

An object of this invention is to provide a novel and useful liquid developer monitoring device which is liberated from the problems mentioned above.

Another object of this invention is to provide a liquid developer monitoring device which is capable of accurately monitoring the physical properties of a liquid developer with a simple construction of circuits.

Another object of this invention is to provide a novel and useful liquid developer controlling system and an image forming apparatus which are liberated from the drawbacks mentioned above.

Another object of this invention is to provide a liquid developer controlling system which is capable of controlling the composition of a liquid developer stably.

Another object of this invention is to provide an image forming apparatus which is capable of producing images of good quality for a long time.

To accomplish the objects mentioned above, a preferred embodiment of this invention is characterized by comprising a liquid developer monitoring device comprising a first electrode which contacts with a liquid developer comprising a liquid medium and electrically charged toner particles dispersed therein, a second electrode which provides a fresh surface and immerses said surface in the liquid developer, an electric power source which applies a bias voltage between said first and second electrodes so as to deposit the toner particles on the second electrode, and a sensor which measures magnitude of current flowing between said first and second electrodes during the deposition of the toner particles.

BRIEF DESCRIPTION OF THE DRAWINGS

The following is a brief description of the accompanying drawings, which show a preferred embodiment of the invention.

DESCRIPTION OF THE PREFERRED EMBODIMENTS

Now, embodiments of this invention will be described below with reference to the accompanying drawings.

<Embodiment 1>

Embodiment 1 represents a case of effecting the development of an image by the use of a liquid developer having a toner, a charge controlling agent, and a liquid medium as main components thereof and using three kinds of replenishing liquid, namely a toner replenishing liquid having the toner and the liquid medium as main components thereof, a charge controlling agent replenishing liquid having the charge controlling agent and the liquid medium as main components thereof, and a liquid medium replenishing liquid solely using the liquid medium. The replenishment of the charge controlling agent replenishing liquid is carried out by measuring the magnitude of electrodeposition current of the toner and thereby monitoring the physical properties of the liquid developer and determining the amount of the charge controlling agent replenishing liquid based on the results of the monitoring.

Figure 1:
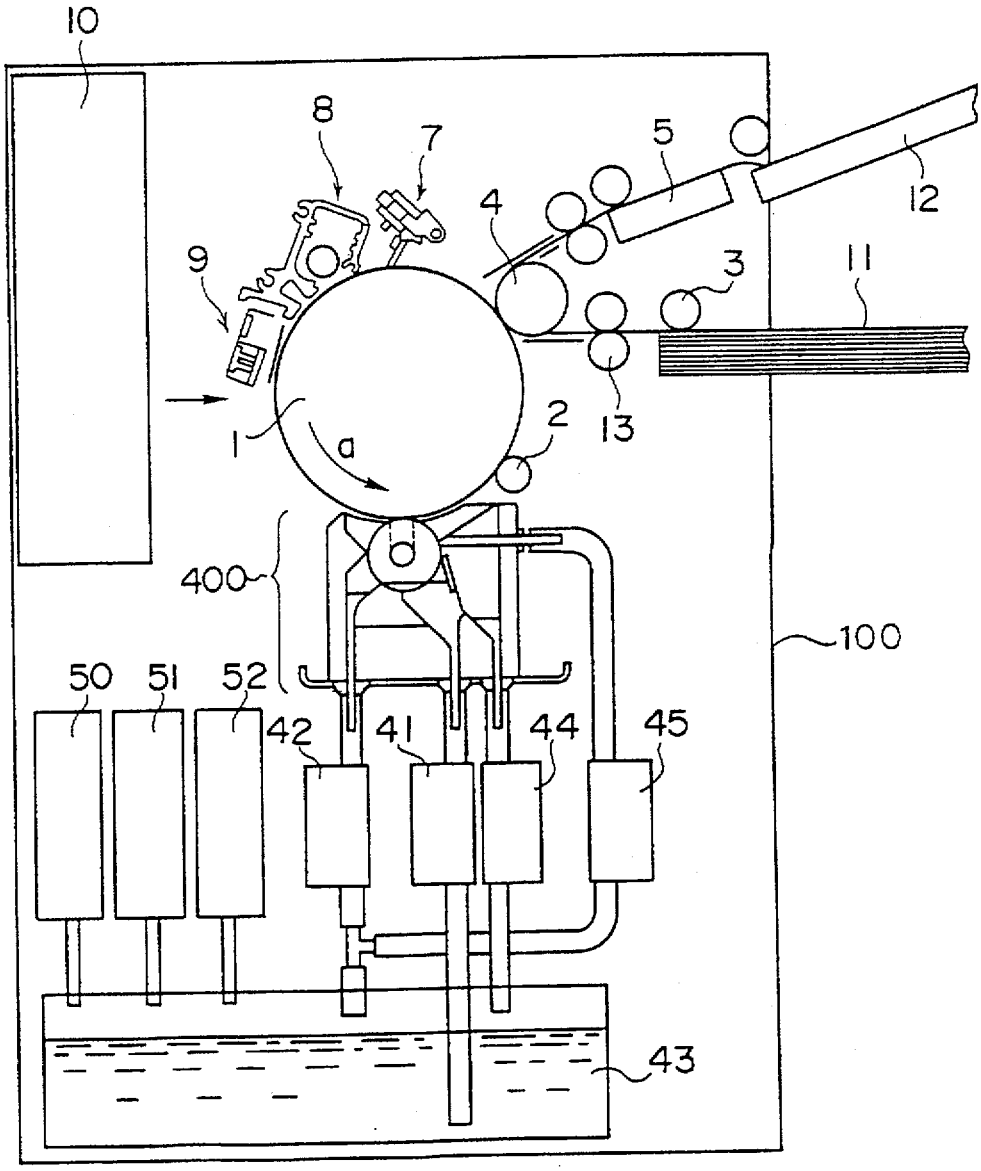
FIG. 1 is a cross section showing a liquid developing type electrophotographic printer as one embodiment of this invention.
Figure 2:
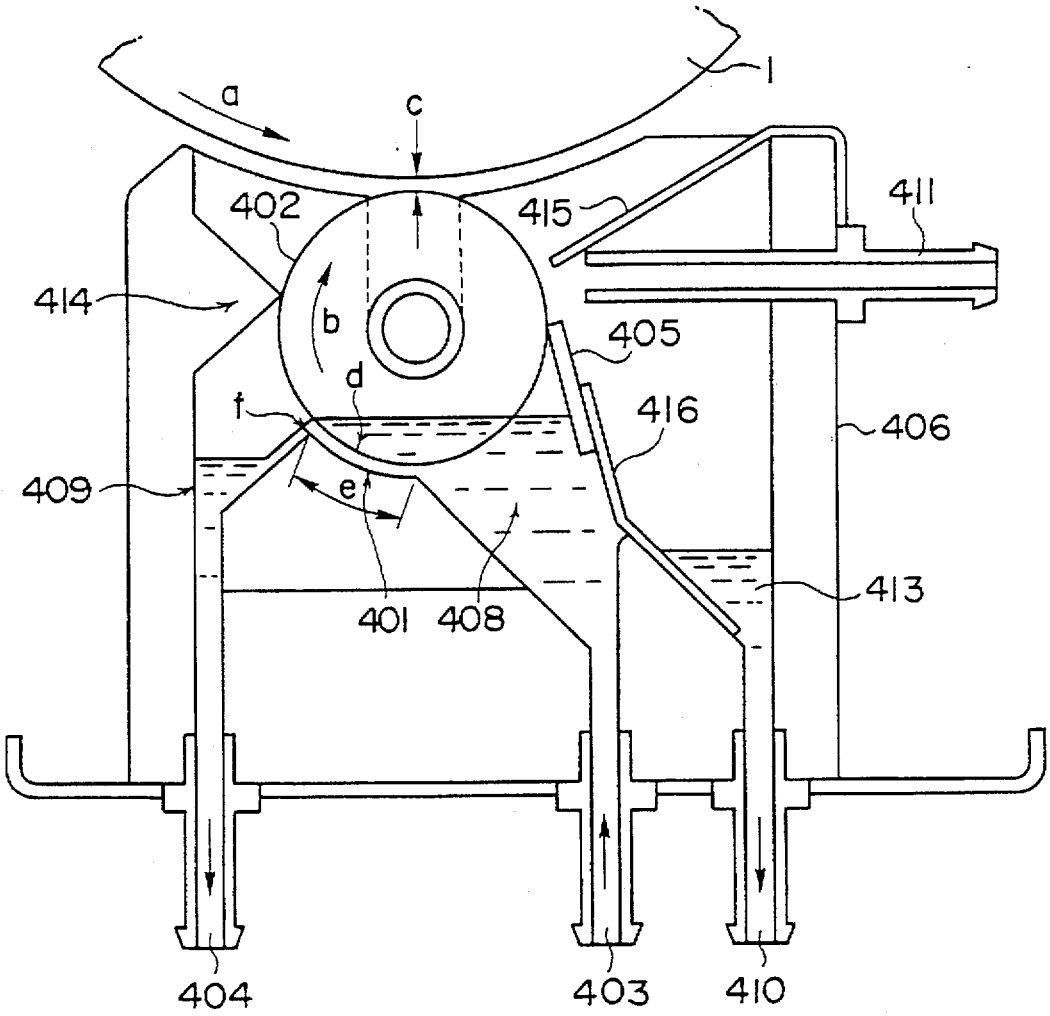
FIG. 2 is a magnified diagram showing the neighborhood of a liquid developing device in the electrophotographic printer.
Figure 3:
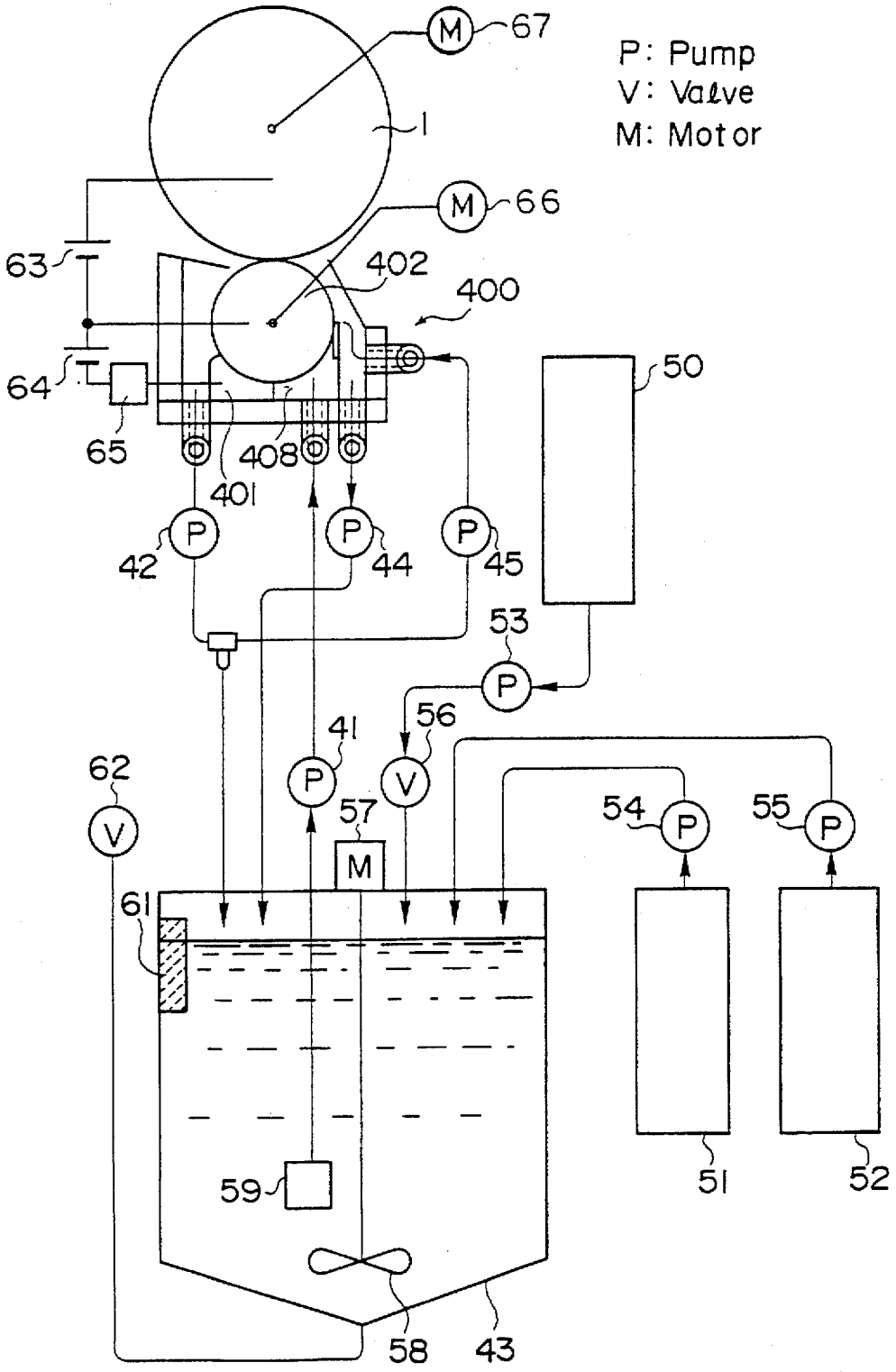
FIG. 3 is a diagram showing a liquid path in the electrophotographic printer.

FIG. 1 is a cross section showing a liquid developing type electrophotographic printer as the first embodiment of this invention, FIG. 2 a partially magnified diagram of a developing device of the printer, and FIG. 3 a diagram to aid in the description of the flow of a liquid developer.

First, the construction and the operation of this electrophotographic printer will be described below.

As shown in FIG. 1, in the printer 100, a cylindrical photosensitive member 1 destined to permit formation of an electrostatic latent image on the surface thereof is disposed so as to be rotated in the direction indicated by an arrow a in the diagram. Around the periphery of the photosensitive member 1 as a latent image carrying member, a laser generator 10 for generating a laser beam based on image data transmitted as from a host computer not shown in the diagram, a liquid developing device 400, a squeeze roller 2, a transfer roller 4, a cleaner 7, an eraser lamp 8, and an electric charger 9 are sequentially disposed in the order mentioned. In the lateral part of the printer, a paper holding cassette 11 for holding papers in the interior thereof, a fixing device 5 for fixing a toner image formed on a paper, and a discharge paper tray 12 for stacking thereon papers discharged out of the printer.

The printer 100 is provided therein with a liquid developer tank 43 for storing the liquid developer, a liquid supply pump 41 for supplying the liquid developer held in the liquid developer tank 43 to the liquid developing device 400, a liquid recovery pump 42 and a residual liquid recovery pump 44 for returning the liquid developer remaining in the liquid developing device 400 to the liquid developer tank 43, a toner replenishing liquid tank 50 for storing a toner replenishing liquid for replenishing the toner component, a charge controlling agent replenishing liquid tank 51 for storing a charge controlling agent replenishing liquid for replenishing the charge controlling agent component, and a liquid medium replenishing liquid tank 52 for storing a liquid medium replenishing liquid for replenishing the liquid medium.

The liquid developer is produced by causing toner particles having a coloring agent dispersed in a binding resin to be dispersed in a liquid medium of high resistance and having a charge controlling agent further incorporated in the resultant dispersion. The toner replenishing liquid is produced by adding toner particles to a liquid medium. The charge controlling agent replenishing liquid is produced by adding a charge controlling agent to a liquid medium. The liquid medium replenishing liquid is formed solely of a liquid medium.

The detailed compositions of the liquid developer and the various replenishing liquids mentioned above and the methods for controlling the replenishment of the replenishing liquids will be described hereinbelow.

The printer described above is operated as follows.

When the photosensitive member 1 held in the printer is set rotating, uniformly charged by the electric charger 9, and then exposed to a laser beam emitted from the laser generator 10, it has an electrostatic latent image formed on the surface thereof. This latent image is developed by the liquid developing device 400. Thereafter, the excess liquid medium which is adhering to the photosensitive member 1 is removed by the squeeze roller 2.

The uppermost of the stack of papers held in the cassette 11 is supplied by a paper supply roller 3 into the printer 100 and then conveyed by a timing roller 13 to the opposed parts of the transfer roller 4 and the photosensitive member 1 as synchronized with the toner image on the photosensitive member 1. The transfer roller 4 induces the toner image to be electrostatically transferred to the paper because it has applied thereto the voltage which is opposite in polarity to the toner. The paper to which the toner has been transferred is dried and, at the same time, caused to fix the toner thereon by the fixing device 5 and delivered onto the discharge paper tray 12. Subsequently, the developer remaining on the surface of the photosensitive member 1 is removed by the cleaner 7 and the latent image remaining on the photosensitive member 1 is removed by the eraser lamp 8, with the result that the sensitive member 1 is reset. When the cycle consisting of the steps of electric charging, exposure, development, squeezing, transfer, cleaning, and erasure mentioned above is completed, the image is formed on the paper.

The construction and the operation of the developing device will be described more specifically below.

FIG. 2 is a magnified diagram of the developing device 400. As shown in FIG. 2, the developing device 400 is provided with a developing roller 402 for carrying the liquid developer on the surface thereof, a frame 406 for supporting the developing roller 402, a developing liquid tank 408 for storing the liquid developer, a liquid recovery tank 409 for recovering the liquid developer overflowing the developer liquid tank 408, a cleaning blade 405 for scraping the liquid developer remaining on the developing roller 402, a nozzle 411 for blowing a cleaning liquid onto the developing roller 402, and a toner recovery tank 413 for recovering the developer scraped by the cleaning blade 405.

The developing roller 402 is a cylindrical metallic part and is disposed parallelly to the longitudinal direction of the photosensitive member 1 and supported by the frame 406 so as to be rotated in the direction indicated by an arrow b in the diagram. The distance between the photosensitive member 1 and the developing roller 402 in their opposed parts (developing part) c is adjusted at 200 μm.

The developing liquid tank 408 is disposed below the developing roller 402 and is provided at the bottom thereof with a liquid supplying aperture 403 connected to the liquid supplying pump 41 shown in FIG. 1. At the outset of the development, the liquid developer is supplied through the liquid supplying aperture 403 and the lower part of the developing roller 402 is immersed in the liquid developer held in the developing liquid tank 408.

Part of the upper end of the wall forming the developing liquid tank 408 approximates closely to the lower part of the developing roller 402 and constitutes itself an edge part f which extends parallelly to the longitudinal direction of the developing roller 402. After the developing liquid tank 408 has been filled to capacity with the liquid developer, the excess liquid developer overflows this edge part f.

The inner wall surface of the developing liquid tank 408 extending from the edge part f through the part opposed to the lowermost point of the developing roller 402 forms a circumferential surface separated by a stated distance from the developing roller 402. This circumferential surface constitutes an electrode (hereinafter referred to as "thin-layer forming electrode") 401 which serves the purpose of causing electrical adhesion of the toner to the surface of the developing roller 402 by application of voltage between itself and the developing roller 402.

In the present embodiment, the developing roller 402 and the electrode 401 concurrently serve as part of means for detecting the amount of electric charge of the liquid developer. To be specific, this detection of the amount of electric charge of the liquid developer is implemented by measuring the magnitude of electric current (electrodeposition current of the toner) flowing between the developing roller 402 and the electrode 401 at the same time that the toner is electrodeposited on the developing roller 402 for the purpose of effecting the development.

The toner recovery tank 413 is approximated closely to the developing liquid tank 408 as disposed on the opposite side to the liquid recovery tank 409. A liquid blocking plate 416 is attached to the upper end of the inner wall surface of the toner recovery tank 413. The liquid blocking plate 416 is extended upwardly to serve as a boundary between the developing liquid tank 408 and the toner recovery tank 413.

The cleaning blade 405 is attached to the upper end of the liquid blocking plate 416. The upper end of this cleaning blade 405 is held in contact with the developing roller 402. The cleaning blade 405 is made of polyurethane and is pressed against the surface of the developing roller 402 with suitable pressure by the liquid blocking plate 416. As respects the material for the blade, rubber or resin, especially polyurethane, proves proper where the developing roller 402 is made of such material as metal or hard resin. A blade made of such material as metal, resin, or ceramic is properly used where the developing roller 402 is made of such a flexible material as, for example, NBR (nitrile rubber).

The liquid blocking plate 416 concurrently serves the purpose of separating the developing liquid tank 408 and the toner recovery tank 413 from each other and supporting the cleaning blade 405. It, therefore, simplifies the construction and proves advantageous in terms of cost.

The nozzle 411 is connected to a cleaning liquid supplying pump 45, disposed above the cleaning blade 405, and provided with a plurality of spouting apertures spaced by a stated interval in the longitudinal direction of the developing roller 402 and directed toward the developing roller 402.

A liquid cutting member 414 for cutting part of the liquid developer held on the developing roller 402 and lowering it to a stated amount is disposed above the liquid recovery tank 409. The liquid cutting member 414, when the cleaning blade 405 scrapes the liquid developer, manifests an effect of containing the removed liquid developer and preventing it from being scattered outwardly. Further, above the nozzle 411 is disposed a liquid splash preventing plate 415 for preventing the liquid developer held in the developing device 400 from being splashed or vaporized.

Now, the operation of the liquid developing device 400 will be described in detail below.

First, the liquid supply pump 41 is set operating to supply the liquid developer through the liquid supply aperture 403 into the developing liquid tank 408. The liquid developer, after being passed between the opposed parts (thin layer forming part) d of the developing roller 402 and the electrode 401 and through the liquid recovery tank 409, is recovered from a liquid recovery aperture 404 into the liquid developer tank 43 by the liquid recovery pump 42 and again supplied thence to the developing device 400 by the liquid supply pump 41. During the development, the liquid developer is circulated within the developing device 400 as described above.

In the developing device 400, the liquid recovery pump 42 is provided with a greater capacity for liquid recovery than the capacity of the liquid supply pump 41 for liquid supply. The level of the liquid developer held in the developing device 400, therefore, is substantially fixed as shown in FIG. 2 at the highest position that is slightly higher than the edge part f (the upper end of the thin-layer forming electrode 401) of the developing liquid tank 408.

Meanwhile, the developing roller 402 begins to rotate in the direction indicated by the arrow b. After the application of a predetermined magnitude of voltage between the thin layer forming electrode 401 and the developing roller 402 has been started and while the liquid developer is passing through the thin layer forming part d, since the electrically charged toner particles in the liquid developer is moved toward the developing roller 402 under the influence of the electrostatic force, a thin layer of the toner is formed on the surface of the developing roller 402 and a layer of liquid medium containing substantially no toner is formed further thereon.

When the length of the thin layer forming part d (the range indicated by an arrow e in FIG. 2) is set in the range of 3–80 mm, preferably 5–50 mm, ample time is secured for the movement of the toner necessary for the formation of the thin layer and the liquid developer is enabled to form a thin layer with high concentration.

When the distance between the thin layer forming electrode 401 and the developing roller 402 (hereinafter referred to as "thin layer forming gap") is set in the range of 0.1–10 mm, preferably 0.3–3 mm, the liquid developer is allowed to flow smoothly to the thin layer forming part d and consequently form a layer of liquid developer composed of a thin layer of toner and a layer of liquid medium.

In the present embodiment, the length of the thin layer forming part d is set at 25 mm and the distance between the thin layer forming electrode 401 and the developing roller 402 at 1 mm.

The voltage to be applied between the thin layer forming electrode 401 and the developing roller 402 is advantageously formed of DC, DC overlapped by AC, or DC overlapped by voltage of the form of pulse for the sake of heightening the effect of uniformly forming the thin layer of toner on the developing roller 402. The present embodiment elects to apply a DC voltage of 1000 V.

When the electric charge put on the toner is small during the formation of the thin layer of toner, the toner deposited on the developing roller 402 has such a low concentration as exerts an adverse effect on the image to be formed. This embodiment, therefore, contemplates adjusting the amount of electric charge of the toner in the liquid developer, as will be specifically described hereinbelow, based on the amount of electric charge of the toner to be found by measuring the magnitude of electric current flowing between the thin layer forming electrode 401 and the developing roller 402 during the electrodeposition of toner.

Since the developing bias is applied to the developing roller 402 on which the thin layer of toner has been formed, the latent image on the photosensitive member 1 is developed with the toner.

Particularly in the present embodiment, the part of the layer containing the toner at a high concentration avoids directly contacting the photosensitive member 1 and the occurrence of fogging in the image can be prevented because the photosensitive member 1 and the developing roller 402 are in such a state as retains a stated gap as mentioned above. From this point of view, the distance between the two components is appropriately set in the range of 0.1–2 mm. Alternatively, a method which implements the development by means of contact between the photosensitive member and the developing roller may be adopted. This method is characterized by permitting the development to be effected at a high speed. Even in this mode, the present invention can be embodied.

The rotational speed of the developing roller 402 is equalized with that of the sensitive member 1. This measure is intended to preclude the possibility that shear strength will act on the toner tending to adhere to the photosensitive member 1 and will consequently disturb the image. The two rotational speeds, when necessary, may be differentiated. The amount of the toner to be supplied to the sensitive member 1 can be increased by giving to the developing roller 402 a higher rotational speed than to the photosensitive member 1. The amount of the toner supplied to the photosensitive member 1 can be decreased by causing the developing roller 402 to be rotated at a lower speed than the photosensitive member 1. The ratio of rotational speed of the developing roller 402 to the photosensitive member 1 is properly in the range of 0.5–10, preferably 0.9–5. Further, the direction of the rotation of the developing roller 402 may be reversed from the direction of the arrow b shown in FIG. 2, namely in the direction contrary to the direction of rotation of the photosensitive member 1 (indicated by the arrow a shown in the diagram). This reversion of the direction of rotation allows a decrease in the amount of liquid suffered to adhere to the photosensitive member 1.

The developer that still remains on the surface of the developing roller 402 after the surface has passed the developing area is scraped by the cleaning blade 405. By the time that the surface of the developing roller 402 reaches the developing liquid tank 408, it has assumed a fresh surface free from adhesion of the toner.

The cleaning liquid is spouted via the nozzle 411 against the developing roller 402. As a result, the possibility that part of the surface of the developing roller 402 will escape being wiped is precluded and, at the same time, the possibility that the rotational torque of the developing roller 402 will be increased is prevented.

In this embodiment, part of the developing liquid returned from the liquid recovery pump 42 to the liquid developer tank 43 is scooped up by the cleaning liquid supply pump 45 and used as the cleaning liquid. As a result, it becomes unnecessary to use an exclusive cleaning liquid or to provide an exclusive container for storing the cleaning liquid. The aforementioned liquid which is used as the cleaning liquid in this embodiment has a small amount of solid content and proves suitable for cleaning.

The cleaning liquid does not need to be limited to the liquid contemplated by this embodiment. Various liquids which are incapable of dissolving the toner can be adopted as the cleaning liquid. It is permissible to scoop up the liquid developer held in the liquid developer tank 43 and use it as the cleaning liquid. It is also allowable to use a replenishing liquid for fixing the toner concentration in the liquid developer at a predetermined level.

The developer which has been scraped by the cleaning blade 405 flows down the liquid blocking plate 416 into the toner recovery tank 413. As a result, the developer which remained on the developing roller 402 has no possibility of flowing directly into the developing liquid tank 408 and consequently altering the toner concentration of the liquid developer held in the developing liquid tank 408.

The liquid developer which has flowed into the toner recovery tank 413 is recovered via a residual liquid recovery aperture 410 and returned to the liquid developer tank 43 by the toner recovery pump 44.

When the development is completed as described above, the application of voltage is terminated and, at the same time, the liquid supply pump 41, the liquid recovery pump 42, and the developing roller 402 are stopped. The liquid developer held in the developing liquid tank 408 is quickly dropped under its own weight toward the liquid developer tank 43 via the liquid supply aperture 403 and the liquid recovery aperture 404.

The surface roughness of the developing roller 402 is set below 5 μm on the ten-point average roughness scale. Owing to this surface roughness, such detriments as the disturbance of image due to the contact between the photosensitive member 1 (image carrying member) and the developing roller 402, the breakage of the thin layer of toner due to the contact between the developing roller 402 and the thin layer forming electrode 401, the uneven development due to the uneven application of an electric field between the photosensitive member 1 and the developing roller 402, and the uneven thin layer of toner due to the uneven interval between the developing roller 402 and the thin layer forming electrode 401 can be precluded. The ten-point average roughness is defined in JIS (Japanese Industrial Standard) B-0601.

Now, the operation for supply of the replenishing liquids will be described below.

The liquid developer in the liquid developer tank 43 is caused to retain a uniform concentration by means of a stirring vane 58 which is rotated by the motive force of a stirring motor 57 as shown in FIG. 3. The liquid supply pump 41 is provided at the leading end part thereof with a concentration sensor 59 adapted to measure the liquid concentration optically. The start of printing sets the liquid supply pump 41 operating to supply the liquid developer to the developing liquid tank 408. The liquid developer is passed through the thin layer forming part d jointly defined by the developing roller 402 and the thin layer forming electrode 401 as described above and is then returned by the liquid recovery pump 42 to the liquid developer tank 43. At this time, the toner concentration of the liquid developer supplied by the liquid supply pump 41 is measured by the concentration sensor 59. When the concentration is found by this measurement to be insufficient, a replenishing pump 53 and a valve 56 are so controlled as to forward the toner replenishing liquid from the replenishing tank 50 to the liquid developer tank 43.

At the outset of the development, photosensitive member 1 and developing roller 402 are rotated by drive motor 67 and developing roller 402 are rotated by drive motor 67 and developing motor 66 respectively, and an electrodeposition power source 64 applies voltage to the thin layer forming part d and the toner is electrodeposited as described above on the developing roller 402. Suitable bias means 63 applies voltage between the developing roller 402 and the photosensitive member 1 and the latent image on the sensitive member 1 is developed with the toner without entraining the phenomenon of fogging. At this time, an electrodeposition current sensor 65 measures the electrodeposition current. If the electrodeposition current fails to reach a predetermined magnitude, the charge controlling agent replenishing liquid will be supplied by a replenishing pump 54 from the replenishing tank 51 into the liquid developer tank 43.

The liquid developer tank 43 is provided with a liquid amount sensor 61. If the amount of liquid fails to reach a predetermined level, the liquid medium replenishing liquid will be supplied by a replenishing pump 55 from the replenishing tank 52.

Here, each operation for supply of the toner replenishing liquid, the charge controlling replenishing liquid and the liquid medium replenishing liquid will be described respectively.

Figure 4:
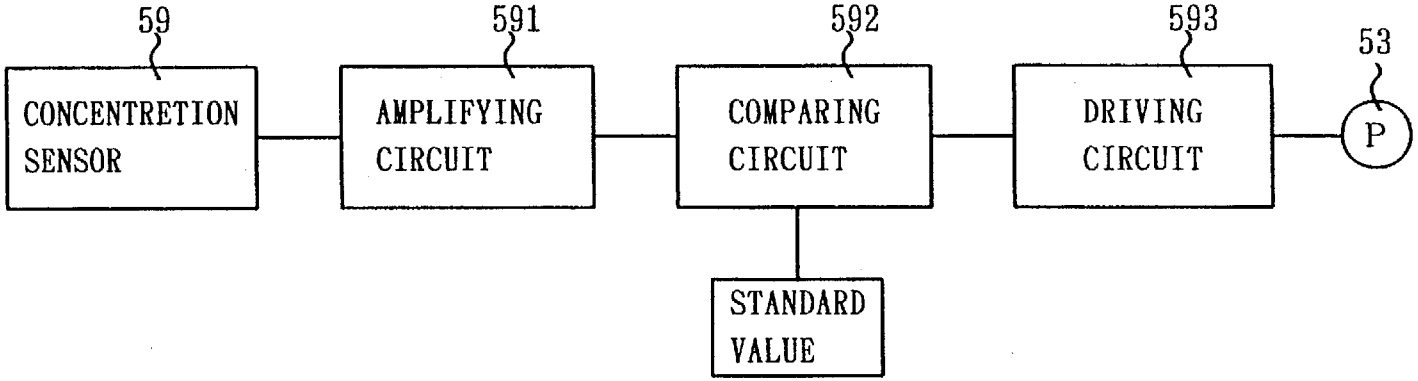
FIG. 4 is a block diagram showing a replenishment control system for a toner replenishing liquid in the electrophotographic printer.
Figure 5:
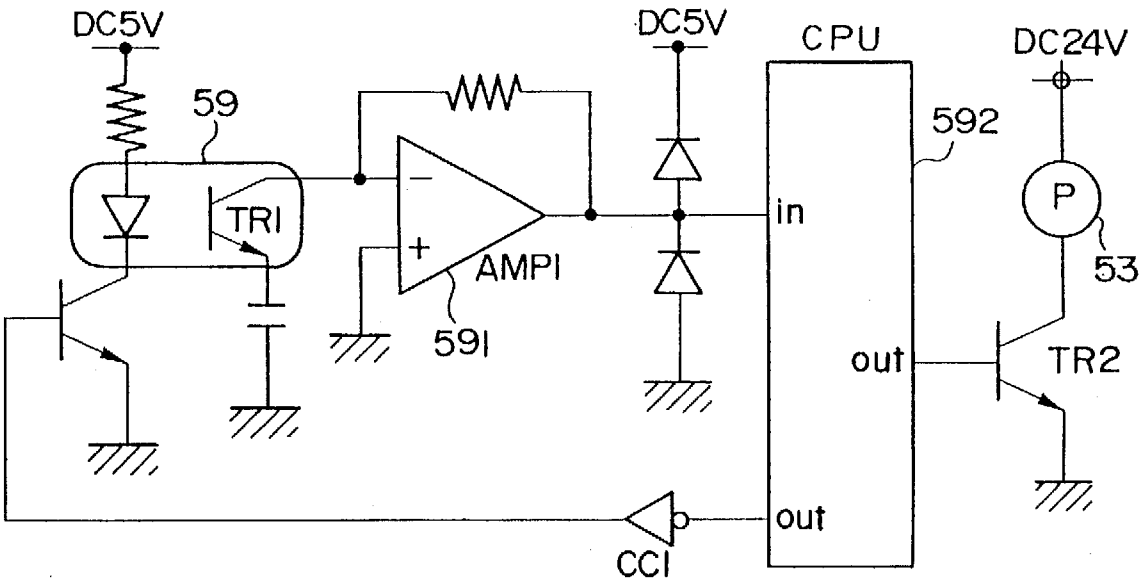
FIG. 5 is a circuit diagram showing a replenishment control system for a toner replenishing liquid in the electrophotographic printer.

FIG. 4 is a block diagram showing a toner replenishing liquid control system and FIG. 5 is a circuit diagram showing a specific circuit construction for the control system mentioned above. The concentration sensor 59 is composed of an LED and a phototransistor TR1. It determines the toner concentration of the liquid developer by measuring the transmittance of this liquid developer. The concentration sensor 59 measures the toner concentration in the liquid developer tank 43 and emits a signal corresponding to the result of the measurement. The signal from the concentration sensor 59 is amplified by an amplifying circuit (AMP1) 591 and introduced into a comparison circuit 592, specifically a CPU. In the comparison circuit 592, the level of the signal from the concentration sensor 59 is compared with the standard value. When the signal level is found by this comparison to be lower than the standard value, the toner concentration is judged to be insufficient and a drive circuit (TR2) 593 sets the replenishing pump 53 operating so as to induce supply of the toner replenishing liquid into the liquid developer tank 43.

Figure 6:
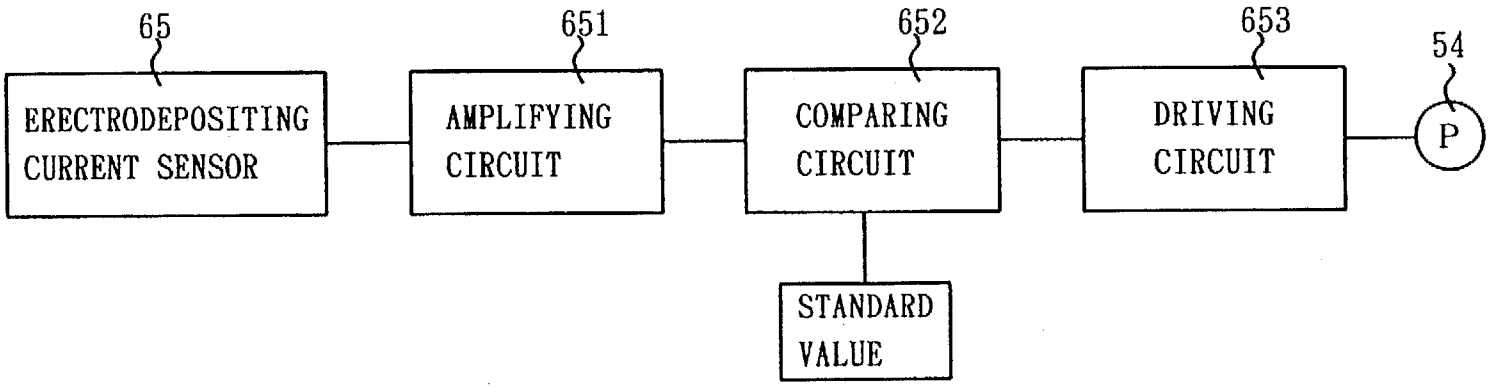
FIG. 6 is a block diagram showing a replenishment control system for a charge controlling agent replenishing liquid in the electrophotographic printer.
Figure 7:
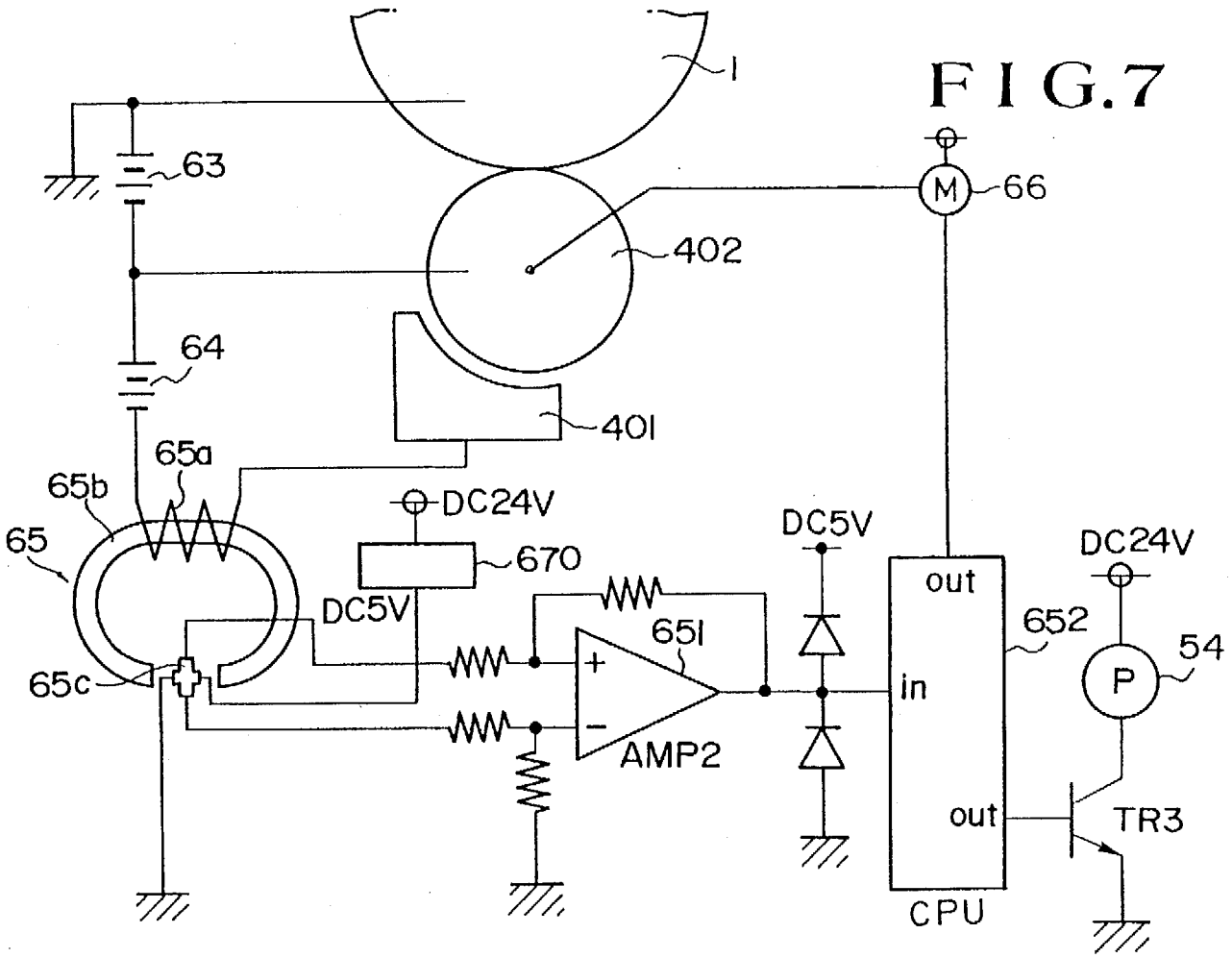
FIG. 7 is a circuit diagram showing a replenishment control system for a charge controlling agent replenishing liquid in the electrophotographic printer.

FIG. 6 is a block diagram showing a charge controlling agent replenishing liquid control system and FIG. 7 is a circuit diagram showing a specific circuit of the system mentioned above. The electrodeposition current sensor 65 uses a coil 65*a*, a magnet 65*b*, and a Hall element 65*c*. Since the coil 65*a* generates a magnetic field corresponding to an electrodeposition current and the Hall element 65*c* converts the magnetic field into an electric field, the electrodeposition current sensor 65 is enabled to emit an electric signal corresponding to the magnitude of electrodeposition current and monitors the amount of electric charge put on the toner in the liquid developer in the form of an electric signal.

The signal from the electrodeposition current sensor 65 is amplified by an amplifying circuit (AMP2) 651 and introduced into a comparison circuit 652, specifically a CPU. In the comparison circuit 652, the level of the signal from the electrodeposition current sensor 65 is compared with the standard value. When the signal level is found by this comparison to be lower than the standard value, the amount of electric charge put on the toner in the liquid developer is judged to be insufficient and a drive circuit (TR3) 653 sets the replenishing pump 54 operating so as to induce supply of the charge controlling agent replenishing liquid into the liquid developer tank 43. To the Hall element 65*c* is supplied a DC voltage from a constant current source 670.

The toner electrodeposited on the surface of the developing roller 402, after passing the developing part c, is scraped by the cleaning blade 405 (shown in FIG. 2) as already described in consequence of the rotation of the developing roller 402. By the time that the surface of the developing roller 402 reaches the thin layer forming part d, it has assumed a fresh surface (in a state not allowing adhesion of toner). As a result, the magnitude of electrodeposition current can be always measured accurately at the time that the toner is electrodeposited on the surface of the electrode free from deposition of toner.

Particularly in the present example, since the developing roller 402 and the electrode 401 concurrently serve as part of means to detect the amount of electric charge put on the toner of the liquid developer, neither an electrode nor a power source is provided exclusively for the purpose of monitoring the liquid developer. Owing to the construction described above, the amount of electric charge put on the toner itself to be used for the development is measured and the determination of the amount of electric charge can be accurately carried out.

Figure 8:
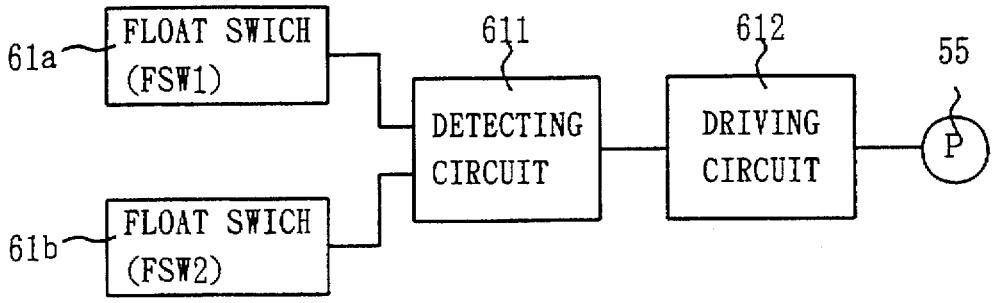
FIG. 8 is a block diagram showing a replenishment control system for a liquid medium replenishing liquid in the electrophotographic printer.
Figure 9:
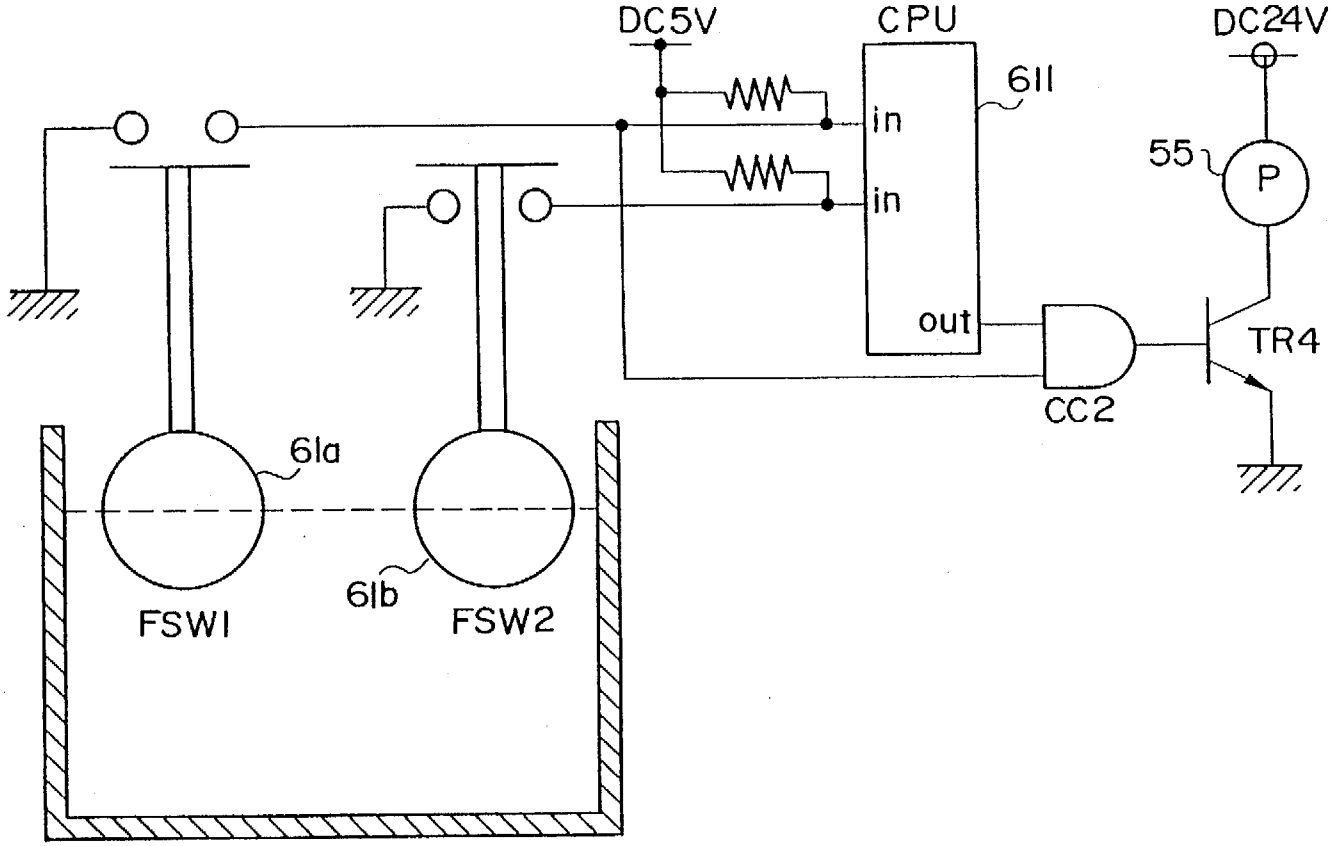
FIG. 9 is a circuit diagram showing a replenishment control system for a liquid medium replenishing liquid in the electrophotographic printer.

FIG. 8 is a block diagram showing a liquid medium replenishing liquid control system and FIG. 9 is a circuit diagram showing a concrete circuit for the control system mentioned above. The liquid amount sensor 61 comprises float switches 61*a* (FSW1) and 61*b* (FSW2) having different positions of detection. The signals one each from the float switches 61*a*, 61*b* are detected by a detection circuit 611, specifically a CPU. When the signal from the float switch 61*a* is detected, the amount of the liquid in the liquid developer tank 43 is judged to be sufficient. Conversely when the signal from the float switch 61*b* is detected, the amount of the liquid is judged to be insufficient and, based on this judgment, a drive circuit (TR4) 612 is actuated to drive the replenishing pump 55 and induce supply of the liquid medium replenishing liquid.

Figure 10A:
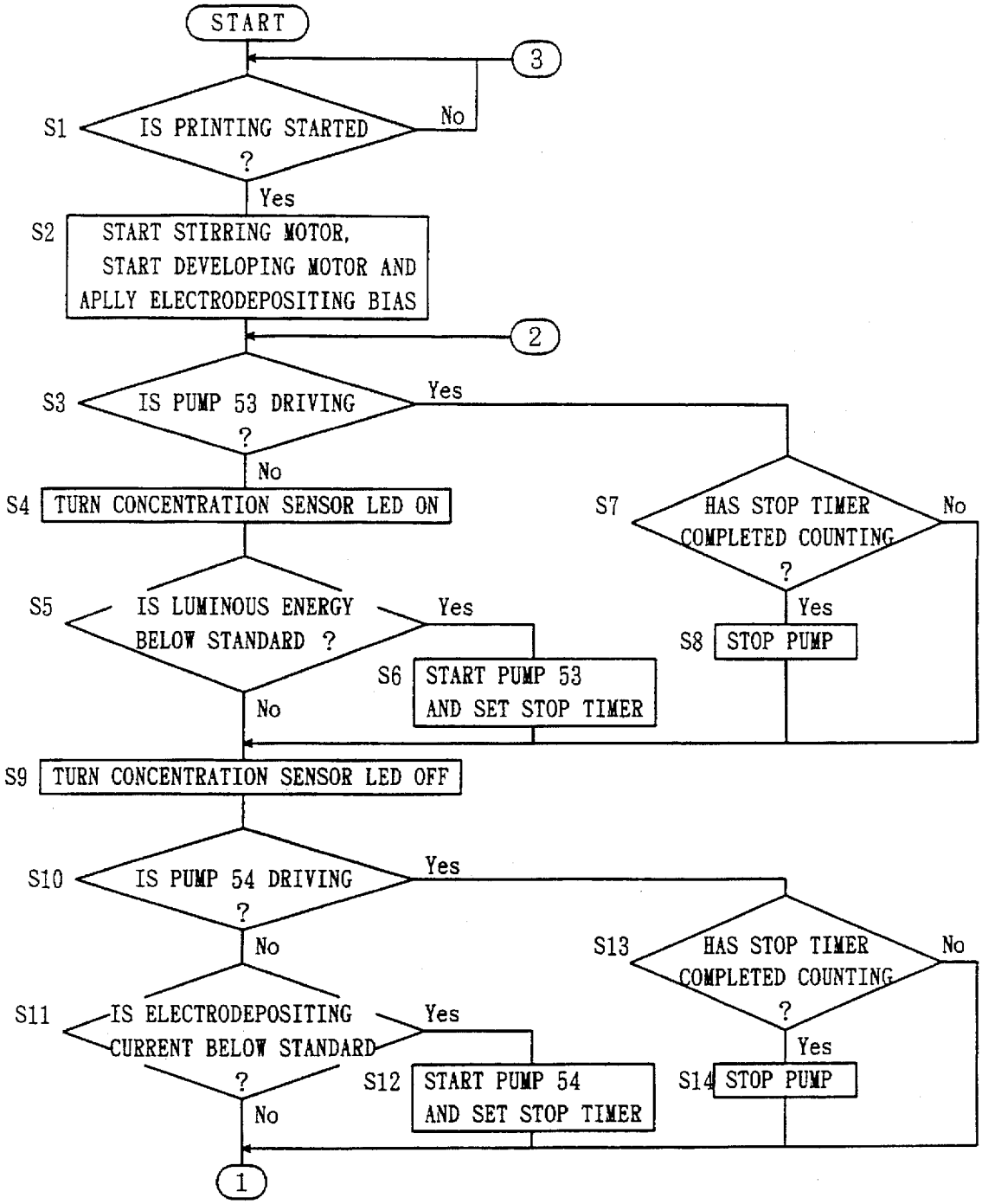
FIGS. 10A and 10B are flow charts to aid in the description of the liquid replenishing operation in the electrophotographic printer.
Figure 10B:
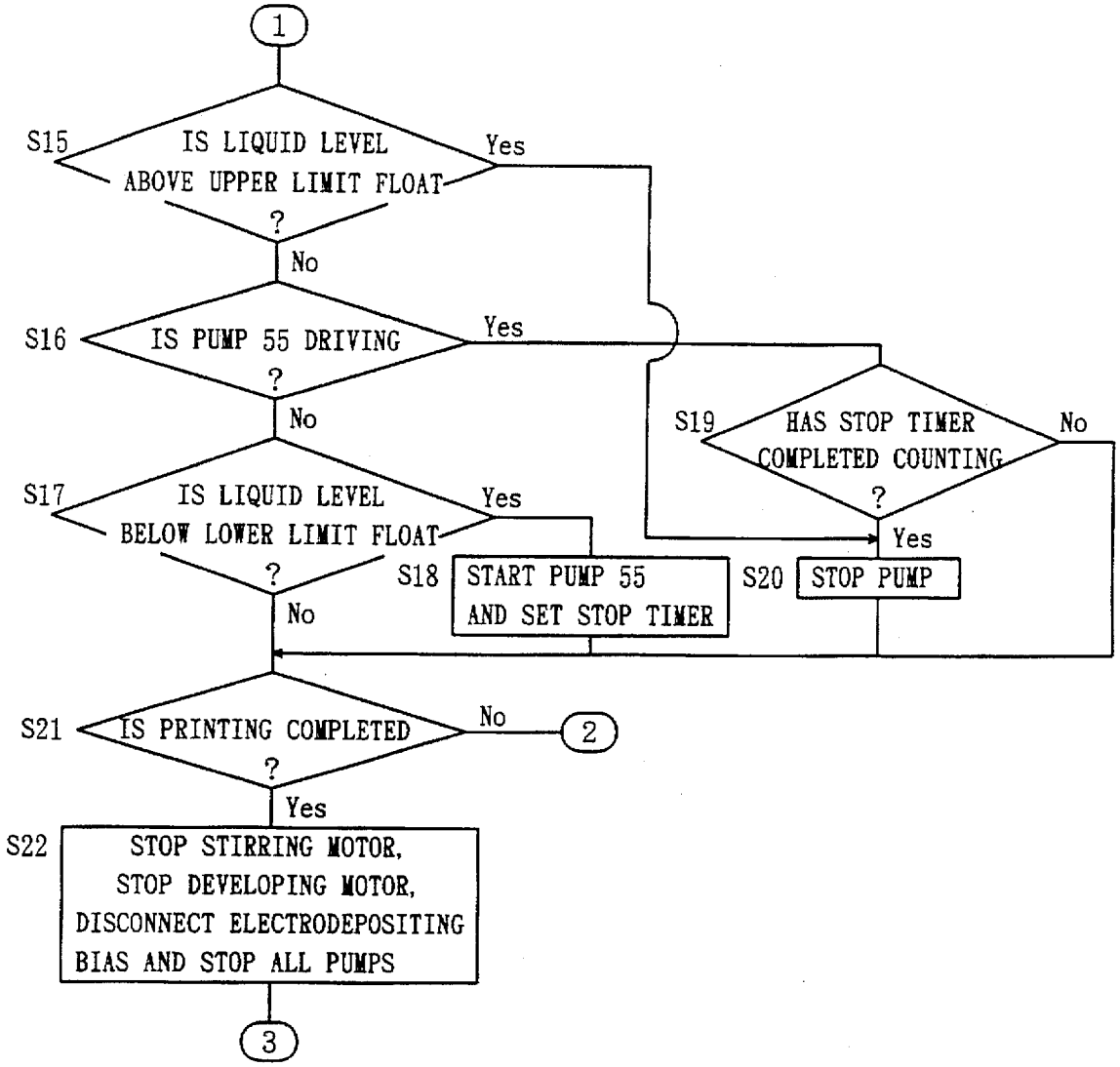

FIG. 10A and FIG. 10B are flow charts showing one example of the algorithm for driving the replenishing pumps 53, 54, and 55 based on the results of the monitoring performed in the systems mentioned above. The algorithm will be described below with reference to FIG. 10A and FIG. 10B.

When the start of printing is detected (S1), start of the stirring motor 57, start of a developing motor 66, and application of an electrodeposition bias (turning on of the electrodeposition power source 64) are severally effected (S2).

Then, the replenishing pump 53 for the toner replenishing liquid is judged to decide whether it is being driven or not (S3). When the replenishing pump 53 is not being driven, the LED of the concentration sensor 61 is turned on (S4). When the luminous energy is found to be below the standard level (S5), the replenishing pump 53 is started and, at the same time, the stop timer is set (S6).

When the replenishing pump 53 is found to be being driven at the aforementioned step S3, the stop timer is judged to decide whether or not it has completed counting (S7). The replenishing pump 53 is stopped when the counting is completed (S8). Then, the LED of the concentration sensor 61 is turned off (S9).

Then, the replenishing pump 54 for the charge controlling agent replenishing liquid is judged to decide whether or not this pump 54 is being driven (S10). When the judgment produces a negative answer, the electrodeposition current is judged to decide whether or not it is below the standard level (S11). When the judgment produces an affirmative answer, the replenishing pump 54 for the charge controlling agent replenishing liquid is started and the stop timer is set (S12).

When the judgment at the aforementioned step S10 produces an affirmative answer, the stop timer is judged to decide whether or not it has completed counting (S13). The replenishing pump 54 is stopped when the counting is completed (S14).

Then, the level of the liquid developer is judged to decide whether or not it is above the upper limit float based on the signal from the float switch 61*a* (S15). When the judgment produces a negative answer, the replenishing pump 55 for the liquid medium replenishing liquid is judged to decide whether or not it is being driven (S16). When this judgment produces a negative answer, the level of the liquid developer is judged to decide whether or not it is below the lower limit float based on the signal from the float switch 61*b* (S17). When the judgment produces an affirmative answer, the replenishing pump 55 is started and the stop timer is set (S18).

When the judgment at the aforementioned step S16 produces an affirmative answer, the stop timer is judged to decide whether or not it has completed counting (S19). The replenishing pump 55 is stopped when the counting is completed (S20). When the judgment at the aforementioned step S15 produces an affirmative answer, too, the replenishing pump 55 is stopped (S20).

Then, the printer is judged to decide whether or not it has completed printing (S21). When this judgment produces a negative answer, the process extending from the step S3 through the step S21 is repeated. When the judgment produces an affirmative answer, the stirring motor 57 is stopped, the developing motor is stopped, the electrodeposition bias is cut off, and all the pumps are stopped (S22). The processing is returned to the judgment (S1) as to the start of printing.

In the flow charts described above, the steps S3 through S8 for the control of the toner replenishing liquid, the steps S9 through S14 for the control of the electrodeposition controlling agent replenishing liquid, and the steps S15 through S20 for the control of the liquid medium replenishing liquid are depicted as being carried out continuously. Optionally, these groups of controlling steps may be carried out parallelly.

The present example is allowed to effect fine adjustment of the balance of the main components of the liquid developer, i.e. a toner, a charge controlling agent, and a liquid medium, because it uses the three kinds of replenishing liquid one each for the main components mentioned above and supplies these replenishing liquids substantially independently of one another as described above.

Now, the compositions of the liquid developer and the replenishing liquids to be used in this embodiment will be described below.

The liquid developer at least comprises toner particles having such coloring agents as pigment and dye dispersed in a binding resin, a charge controlling agent, and a liquid medium of high resistance for dispersing the toner particles and the charge controlling agent therein. It may, when necessary, further incorporate therein a dispersion stabilizer and other additives in suitable amounts.

The resistance of the liquid developer can be optimized and the occurrence of such detriments as image drift an be minimized by adjusting the volume resistivity of the liquid developer to a level of not less than 10 Ω.cm.

Any kind of liquid medium can be used so long as it possess such a magnitude of resistance as avoids disturbing an electrostatic latent image formed on such an image carrying member such as the photosensitive member. The liquid medium is appropriately a solvent which is substantially free from odor and toxicity and has a relatively high flash point. As typical examples of the liquid medium that fulfills the condition, such isoparaffin type hydrocarbon solvents as IP solvent series (produced by Idemitsu Petrochemical Co., Ltd.) and Isoper series (produced by Esso Oil Company) which exhibit high insulating property and low dielectric property may be cited.

The toner (minute colored particles) to be used for the liquid developer has absolutely no restriction. Preferably, the toner exerts only a sparing effect of the difference in kind of pigment on the developability of the liquid developer. To be specific, it is appropriate for the toner to have at least such coloring materials as dye and pigment dispersed in a thermoplastic binding resin.

The method for producing the toner has no restriction of any sort. In various known methods available for the production, (1) a method which obtains a toner by coloring minute binding resin particles with a coloring agent (dye or pigment) and (2) a method which obtains a toner by melting and kneading a coloring agent (dye or pigment) with a binding resin and pulverizing the resultant colored resin by a varying pulverizing technique may be cited as typical examples.

As concrete examples of the method of (1), a method which comprises preparing minute resin particles by such technique as suspension polymerization, emulsion polymerization, non aqueous dispersion polymerization, seed polymerization, emulsion dispersion granulation, spray drying, dry pulverization, or wet pulverization and applying a pigment fast to the surface of the minute resin particles and a method which comprises coloring minute resin particles with a dye in a solvent substantially incapable of dissolving the minute resin particles and capable of dissolving the dye may be cited. As concrete examples of the device for applying a pigment fast to the surface of minute resin particles, Hybridization System (produced by Nara Kikai Seisakujo K.K.), Angmill (produced by Hosokawa Micron K.K.), and Disper Coat (produced by Nisshin Engineering K.K.) may be typically cited.

As concrete examples of the method of (2), a method which comprises melting and kneading a coloring agent (dye or pigment) and a binding resin thereby obtaining a bulk of colored resin, coarsely pulverizing the bulk of colored resin into particles of a particle diameter of about 1 mm, and finely pulverizing the coarse particles by the use of such a dry pulverizing device as a jet mill and a method which comprises finely dividing the coarse particles in a solvent destined to serve as a liquid medium by the use of such a device as a wet media mill may be cited. As typical examples of the dry pulverizing device, Jet Mill (produced by Nippon Pneumatic Kogyo K.K.) and Cryptron Grinder (produced by Kawasaki Jukogyo K.K.) may be cited. As typical examples of the wet media mill, Mitsubishi UF Mill (produced by Mitsubishi Heavy Industries, Ltd.), Aiger Motor Mill (produced by Aiger Japan K.K.), Ultravisco Mill (produced by Aimex K.K.), and Spike Mill (produced by Inoue Seisakujo K.K.) may be cited.

In the liquid developers using the toner particles obtained by such methods for the production of toner as mentioned above, the liquid developer that uses the toner particles obtained by the method of (2) mentioned above which does not easily allow the kind of pigment to produce a difference in the amount of electric charge is advantageously used. In the methods for the production mentioned above, the method which implements wet pulverization by the use of a media mill in an isoparaffin type solvent capable of serving as a liquid medium proves particularly advantageous.

Appropriately, the volume average particle diameter of the toner is in the range of 0.5–5.0 μm, preferably 1.0–4.0 μm. If the particle diameter of the toner is less than 0.5 μm, the mobility of the toner particles may be unduly small and, as a result, the developing speed may be decreased and the image density may be ultimately lowered in a range of system speed exceeding a certain level. Conversely, if the particle diameter of the toner exceeds 5.0 μm, the resolution may be possibly degraded. The developing speed and the image density are both satisfied by keeping the volume average particle diameter of the toner within the range of 0.5–5.0 μm. The volume average particle diameter and the particle diameter distribution of the toner may be measured by the use of an instrument produced by Shimadzu Seisakusho Ltd. and marketed under product code of "SALD-1100," for example.

As the binding resin for the toner, any of the binding resins which are popularly used for toners of the ordinary grade is suitably used. As concrete examples of the binding resin, thermoplastic resins such as styrene type resins, (meth)acrylic type resins, olefin type resins, polyester type resins, amide type resins, carbonate resins, polyethers, and polysulfones, oligomers and prepolymers of such thermosetting resins as epoxy resins, urea resins, and urethane resins, and polymers partially containing a prepolymer, cross-linking agent, etc. may be cited. These resins may be used either singly or in the form of a mixture of two or more members. In order for the toner particles to manifest a fully satisfactory charging property, it is necessary that the binder resin used therein be possessed of a part allowing ready adsorption of ions in the liquid developer on the surface of the toner particles. Specifically, the binding resin must possess a high acid value. The charging property may be exalted, for example, by blending the toner binder with a polar group-containing polymer or a polar group-containing compound or by modifying the surface of toner particles thereby imparting an improved ion-adsorbing property thereto.

For the purpose of enabling the binder resin to acquire an increased acid number, this resin is copolymerized with an acidic monomer such as (meth)acrylic acid as a copolymerizable monomer when the resin happens to be a styrene-acrylic type resin. When the resin is a polyester type resin, it requires a small amount of the acidic monomer to be graft polymerized thereto. The acid number of the resin can be adjusted by controlling the grafting ratio of the polymerization.

Generally, the acid number of the binding resin is proper in the range of 5–100 mgKOH/g. In this invention, the acid number of the binding resin is determined as follows.

Five (5) g of a given resin is dissolved in 50 ml of a neutral solvent [toluene-EtOH (2/1)] and the resultant solution is titrated with 0.04M of a KOH-EtOH solution against phenol phthalein as an indicator.

$$\text{Acid number}=(a-b)\times f\times 2.244/w$$

[wherein a stands for the end point of slightly red color (ml), b for the titer in blank test (ml), f for the titer of the 0.04M KOH-EtOH solution, and w for the amount of sample resin (g)].

As concrete examples of the other polar group-containing compound to be blended with the resin binder, organic acids such as carboxylic acids, sulfonic acids, and phosophoric acid, higher fatty acids, minute inorganic oxide particles such as minute silica particles, resin acids such as rosin, and derivatives thereof may be cited.

The improvement of the ion-adsorbing property of toner particles by modifying the surface of the toner particles is accomplished, for example, by a method which comprises applying a fine inorganic oxide powder such as fine silica powder fast to the surface of the toner particles. As concrete examples of the device for applying the fine inorganic oxide powder fast to the surface of the toner particles, Hybridization System (produced by Nara Kikai Seisakujo K.K.), Angmill (produced by Hosokawa Micron K.K.), and Disper Coat (produced by Nisshin Engineering K.K.) may be typically cited.

As the coloring agent for the toner, it is advantageous to use organic dyes and pigments and inorganic pigments which come in various colors and carbon black. Particularly, it is proper to use C. I. Pigment Blue 15-3, C. I. Pigment Yellow 17, C. I. Pigment Red 122, and Morgal L. Generally, these coloring dyes and pigments are properly used in an amount in the range of 3–30 parts by weight, preferably 5–20 parts by weight, based on 100 parts by weight of the resin particles. If the amount of coloring agent exceeds 30 parts by weight, the fixing property of the toner will be degraded. Conversely, if this amount is less than 3 parts by weight, the image may not be obtained with amply high density.

As concrete examples of the charge controlling agent which is added to the liquid developer for the purpose of controlling the amount of electric charge put on the toner in the liquid developer, metal salts of fatty acids such as naphthenic acid, octenoic acid, oleic acid, and stearic acid, metal salts of sulfo-succinic esters, metal salts of alkylsulfonic acids, metal salts of phosphoric esters, metal salts of abietic acid and hydrogenated abietic acid, calcium alkylbenzene sulfonates, metal salts of aromatic carboxylic acids or sulfonic acids, nonionic surfactants such as polyoxyethylated alkyl amines, oils and fats such as lecithin and linseed oil, surfactants of organic acid esters of polyhidric alcohols, and sulfonic acid resins may be cited.

It is permissible to use a disperse charge resin possessing an electrically charging property and exhibiting solubility to the aforementioned liquid medium as a charge controlling agent. The examples of the disperse charge resin answering the description will be shown below.

The following are polymers or copolymers which contain a nitrogen-containing monomer as a component thereof and exhibiting solubility to the liquid medium.

A. (Meth)Acrylates containing an aliphatic amino group:

N,N-dimethylaminoethyl (meth)acrylates, N,N-diethylaminoethyl (meth)acrylates, N,N-dibutylaminoethyl (meth)acrylates, N,N-hydroxyethylaminoethyl (meth)acrylates, N-benzyl-N-ethylaminoethyl (meth)acrylates, N,N-dibenzylaminoethyl (meth)acrylates, N-octyl-N-ethylaminoethyl(meth)acrylates, and N,N-dihexylaminoethyl(meth)acrylates.

B. Nitrogen-containing heterocyclic vinyl monomers:

N-vinyl imidazole, N-vinyl indazole, N-vinyl tetrazole, 4-vinyl pyridine, 2-vinyl pyridine, 2-vinyl quinoline, 4-vinyl quinoline, 2-vinyl pyralidine, 2-vinyl benzoxazole, and 2-vinyl oxazole.

C. N-vinyl-substituted cyclic amide monomers:

N-vinyl-2-pyrrolidone, N-vinyl piperidone, and N-vinyl oxazolidone.

D. (Meth)Acrylamides:

N-methyl acrylamide, N-octyl acrylamide, N-phenylmethyl acrylamide, N-cyclohexyl acrylamide, N-phenylethyl acrylamide, N-α-naphthyl acrylamide, N-phenyl acrylamide, N-p-methoxy-phenyl acrylamide, acrylamide, N,N-dimethyl acrylamide, N,N-dibutyl acrylamide, N-methyl-N-phenyl acrylamide, acryl piperidine, acryl morpholine, and methacrylamides homologous thereto.

E. Aromatic substituted ethylene type monomers containing a nitrogen-containing group:

Dimethylamino styrene, diethylamino styrene, diethylamino methyl styrene, and dioctylamino styrene.

F. Nitrogen-containing vinyl ether monomers:

Vinyl-N-ethyl-phenylaminoethyl ether, vinyl-N-butyl-N-phenylaminoethyl ether, triethanolamine divinyl ether, vinyl diphenylaminoethyl ether, vinyl pyrrolidylamino ether, vinyl-β-morpholinoethyl ether, N-vinyl hydroxyethyl benzamide, and m-amino-phenyl vinyl ether.

The polymers formed of these monomers are advantageously copolymerized with such monomers as hexyl (meth) acrylates, cyclo-hexyl (meth)acrylates, 2-ethylhexyl (meth) acrylates, octyl (meth)acrylates, nonyl (meth)acrylates, decyl (meth)acrylates, dodecyl (meth)acrylates, lauryl (meth)acrylates, stearyl (meth) acrylates, vinyl laurate, vinyl stearate, benzyl (meth)acrylates, phenyl (meth)acrylates, styrene, and vinyl toluene so as to assume a state readily soluble in a (iso)paraffin type liquid medium.

The amount of the charge controlling agent and/or the disperse charge resin to be added is appropriately in the range of 0.1–5.0% by weight, based on the liquid medium in the liquid developer. The ratio of the charge controlling agent and/or the disperse charge resin to the toner particles is appropriately in the range of 1.0–80% by weight, preferably 5–70% by weight.

The liquid developer, when necessary, may incorporate therein polymers of such long-chain alkyl group-containing acrylic monomers as 2-ethylhexyl (meth)acrylates, lauryl (meth)acrylates, and stearyl (meth)acrylates, copolymers (such as, for example, random copolymers, graft copolymers, and block co-polymers) of these monomers with other monomers (such as, for example, styrene, (meth) acrylic acids, and methyl, ethyl, and propyl esters thereof), rosin, and rosin-modified resins, as disperse resins for aiding in stabilizing dispersion of the toner.

Appropriately the amount of these disperse resins to be added is in the range of 1–10% by weight, preferably 2–5% by weight, based on the amount of the toner particles.

When the liquid developer obtained as described above is used where the development of an image is effected by causing the toner electrodeposited on the developing roller 402 to be transferred onto the latent image on the latent image carrying member (Photosensitive member 1), high-speed development can be attained because the toner concentration is uniformly retained in the developing area and the electrodeposition on the developing roller 402 is carried out at a high speed.

Now, concrete examples of the liquid developer and the replenishing liquids to be used in the present embodiment will be shown below.

<Production of disperse charge resin A>

A solution of 95 parts by weight of lauryl methacrylate in 200 parts by weight of IP Solvent 1620 (produced by Idemitsu Petrochemical Co., Ltd.) is prepared. Argon gas is blown into the solution for 10 minutes to displace the gas entrained in the entire reaction system with argon gas. Then, benzoyl peroxide is added as a polymerization initiator in an amount of 1 mol % based on the amount of the lauryl methacrylate to the reaction system and the reaction system is kept at a temperature of 80° C. for four hours to induce polymerization of the monomer in the reaction system. Thereafter, the reaction system is cooled to 30° C. and made to add 5 parts by weight of N-vinyl-2-pyrrolidone and further add azobis-isobutyronitrile in an amount of 1 mol % based on the N-vinyl-2-pyrrolidone. The reaction system is heated to and retained at 90° C. for four hours to complete the polymerization. The lauryl methacrylate/N-vinyl-2-pyrrolidone copolymer consequently obtained in the form of a solution is labeled as "disperse charge resin A."

<Production of liquid developer>

Colored coarsely pulverized particles having an average particle diameter of 100 μm are obtained by preparing a mixture composed of the following components, kneading this mixture by the use of two rolls at 180° C. for four hours, cooling the hot blend, and coarsely pulverizing the cooled blend.

Styrene/butyl acrylate/acrylic acid copolymer: 100 parts by weight
Copolymerizing ratio 70/25/5
Acid number 12.3 mgKOH/g
Mn=35000, Mw/Mn=3.0

Carbon black (produced by Columbia Carbon Corp and marketed under trademark designation of "Morgal L") : 20 parts by weight In a sand mill using soda glass beads of 5.0 mm in diameter as a medium, the colored coarsely pulverized particles in the following composition are preliminarily pulverized and dispersed under the conditions of two hours and 2000 rpm.

Colored coarsely pulverized particles: 30 parts by weight

Disperse charge resin A: 5 parts by weight

IP Solvent 1620 (produced by Idemitsu Petrochemical Co.,

Ltd.): 100 parts by weight

A concentrated liquid developer is obtained by subjecting the preliminarily pulverized and dispersed blend in the sand mill to a wet pulverization and dispersion under the conditions of four hours and 2000 rpm, with the medium changed to soda glass beads of 1.0 mm in diameter.

In the sand mill, the concentrated liquid developer and 900 parts by weight of IP Solvent 1620 added thereto are dispersed for one hour to produce a liquid developer containing toner particles having a volume average particle diameter of 1.5 μm.

<Production of toner replenishing liquid>

Colored coarsely pulverized particles having an average particle diameter of 100 μm are obtained by preparing a mixture composed of the following components, kneading this mixture by the use of two rolls at 180° C. for four hours, cooling the hot blend, and coarsely pulverizing the cooled blend.

Styrene/butyl acrylate/acrylic acid copolymer: 100 parts by weight
Copolymerizing ratio 70/25/5
Acid number 12.3 mgKOH/g
Mn=35000, Mw/Mn=3.0

Carbon black (produced by Columbia Carbon Corp and marketed under trademark designation of "Morgal L") : 20 parts by weight In a sandmill using soda glass beads of 5.0 mm in diameter as a medium, the colored coarsely pulverized particles in the following composition are preliminarily pulverized and dispersed under the conditions of two hours and 2000 rpm.

Colored coarsely pulverized particles: 300 parts by weight

Disperse charge resin A: 3.5 parts by weight

IP Solvent 1620 (produced by Idemitsu Petrochemical Co., Ltd.): 300 parts by weight A concentrated toner replenishing liquid is obtained by subjecting the preliminarily pulverized and dispersed blend in the sandmill to a wet pulverization and dispersion under the conditions of four hours and 2000 rpm, with the medium changed to soda glass beads of 1.0 mm in diameter.

In the sand mill, the concentrated toner replenishing liquid and 700 parts by weight of IP Solvent 1620 added thereto are dispersed for one hour to produce a toner replenishing liquid containing toner particles having a volume average particle diameter of 1.5 μm.

<Production of charge controlling agent replenishing liquid>

A concentrated replenishing liquid is obtained by thoroughly mixing a mixture composed of the following components for one hour.

Disperse charge resin A: 7.0 parts by weight

IP Solvent 1620 (produced by Idemitsu Petrochemical Co., Ltd.): 100 parts by weight A charge controlling agent replenishing liquid is obtained by combining the concentrated replenishing liquid and 900 parts by weight of IP Solvent 1620 and stirring the resultant mixture for one hour.

<Production of liquid medium replenishing liquid>

IP Solvent 1620 (produced by Idemitsu Petrochemical Co., Ltd.) is used in its unmodified form as a liquid medium replenishing liquid. This liquid medium has high electric resistance.

<Embodiment 2>

Figure 11:
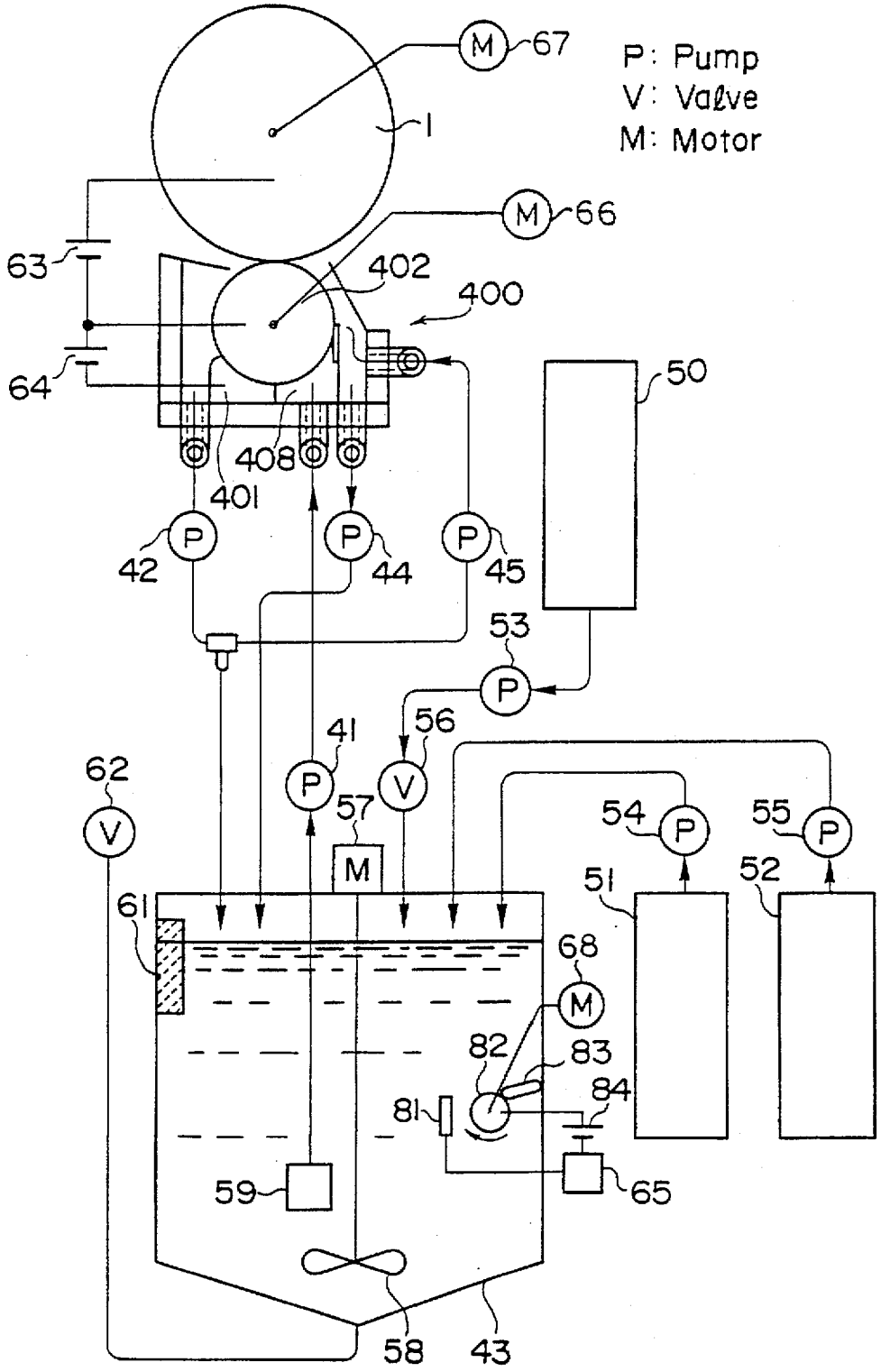
FIG. 11 is a diagram to aid in the description of another construction of a liquid developer monitor used in the electrophotographic printer.

Embodiment 1 described above is depicted as using the thin layer forming electrode 401 and the developing roller 402 in the developing device 400 for the detection of the amount of electric charge of the toner in the liquid developer as described above. A mechanism adapted exclusively to detect the amount of electric charge put on the toner in the liquid developer may be disposed independently of the developing device 400 instead. This Embodiment 2 contemplates independently disposing an electrode adapted to detect the amount of electric charge put on the toner in the liquid developer inside the liquid developer tank 43 as shown in FIG. 11.

In the present embodiment, the liquid developer tank 43 is provided therein a stationary electrode 81 and a rotary electrode 82 opposed to the stationary electrode 81. The rotary electrode 82 is rotated by drive motor 68, and a power source 84 applies voltage between the stationary electrode 81 and the rotary electrode 82. The current sensor 65 measures the magnitude of current which flows during the electrodeposition of the toner to the rotary electrode 82. The rotary electrode 82 is provided with a cleaning blade 83 which is intended to scrape the electrodeposited toner off the rotary electrode 82. As the rotary electrode 82 is rotated in the direction indicated by the arrow in the diagram relative to the cleaning blade 83, the cleaning blade 83 scrapes the electrodeposited toner and exposes the surface of the rotary electrode 82.

By allowing means for monitoring the physical properties of the liquid developer to be disposed independently of the developing device as described above, the construction of the developing device may be suitably altered to some other mode (such as, for example, a construction using a scooping roller or a construction causing direct immersion of the sensitive member in the liquid developer), with due respect paid to such factors as space and cost.

The construction and the operation of the current sensor 65 in the present example are the same as those of the current sensor 65 of Example 1 already described above with reference to FIG. 6. Another construction shown in FIG. 11 is the same as that of Example 1 described above with reference to FIG. 3.

<Embodiment 3>

The compositions of the liquid developer and the replenishing liquids do not need to be limited to those described in the examples cited above. They are only required to contain at least a replenishing liquid for varying the amount of electric charge put on the toner contained in the liquid developer. Thus, the compositions permit wide variation. For example, the toner component and the charge controlling agent component are not always required to be independent of each other. A replenishing liquid which contains the toner and the charge controlling agent together as shown below may be used.

<Charge controlling agent replenishing liquid>

Colored coarsely pulverized particles: 30 parts by weight

Disperse charge resin A: 70 parts by weight

IP Solvent 1620 (produced by Idemitsu Petrochemical Co., Ltd.): 1000 parts by weight <Toner replenishing liquid>

Colored coarsely pulverized particles: 300 parts by weight

Disperse charge resin A: 3.5 parts by weight

IP Solvent 1620 (produced by Idemitsu Petrochemical Co., Ltd.): 1000 parts by weight <Liquid medium replenishing liquid>

IP Solvent 1620 (produced by Idemitsu Petrochemical Co., Ltd.) in its unmodified form is used.

When the composition of the liquid developer is prepared in the form of two separate components, toner and liquid medium, by causing the toner itself to assume an electrically charging property as by the dispersion therein of a coloring agent possessed of an electrically charging property, two replenishing liquids, i.e. a toner replenishing liquid containing the toner and the liquid medium and a liquid medium replenishing liquid formed solely of the liquid medium, are used. The toner replenishing liquid may be supplied based on the result of the measurement of the electrodeposition current.

<Embodiment 4>

The embodiments described above invariably contemplate replenishing the components of the liquid developer based on the result of the monitoring of the physical properties of the liquid developer. This mode of replenishing is not critical. Alternatively, the balance of the components of the liquid developer may be adjusted by controlling the various conditions for the image formation such as the developing bias, the potential on the surface of the photosensitive member, the amount of exposure for writing a recording signal such as of laser, the electrodeposition bias onto the developing roller, and the amount of the liquid developer to be fed to the developing device. Embodiment 4 resides in controlling the developing bias voltage based on the result of the monitoring of the physical properties of the liquid developer.

Figure 12:
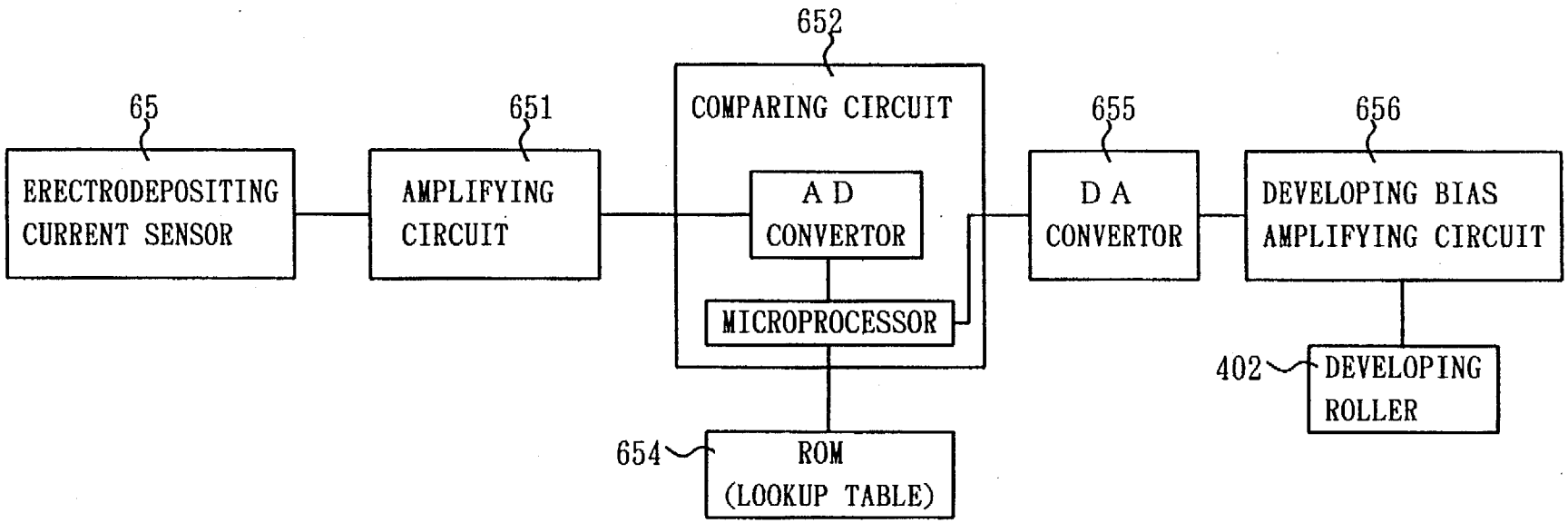
FIG. 12 is a block diagram showing a control system for controlling a developing bias based on the results obtained by the liquid developer monitor.
Figure 13:
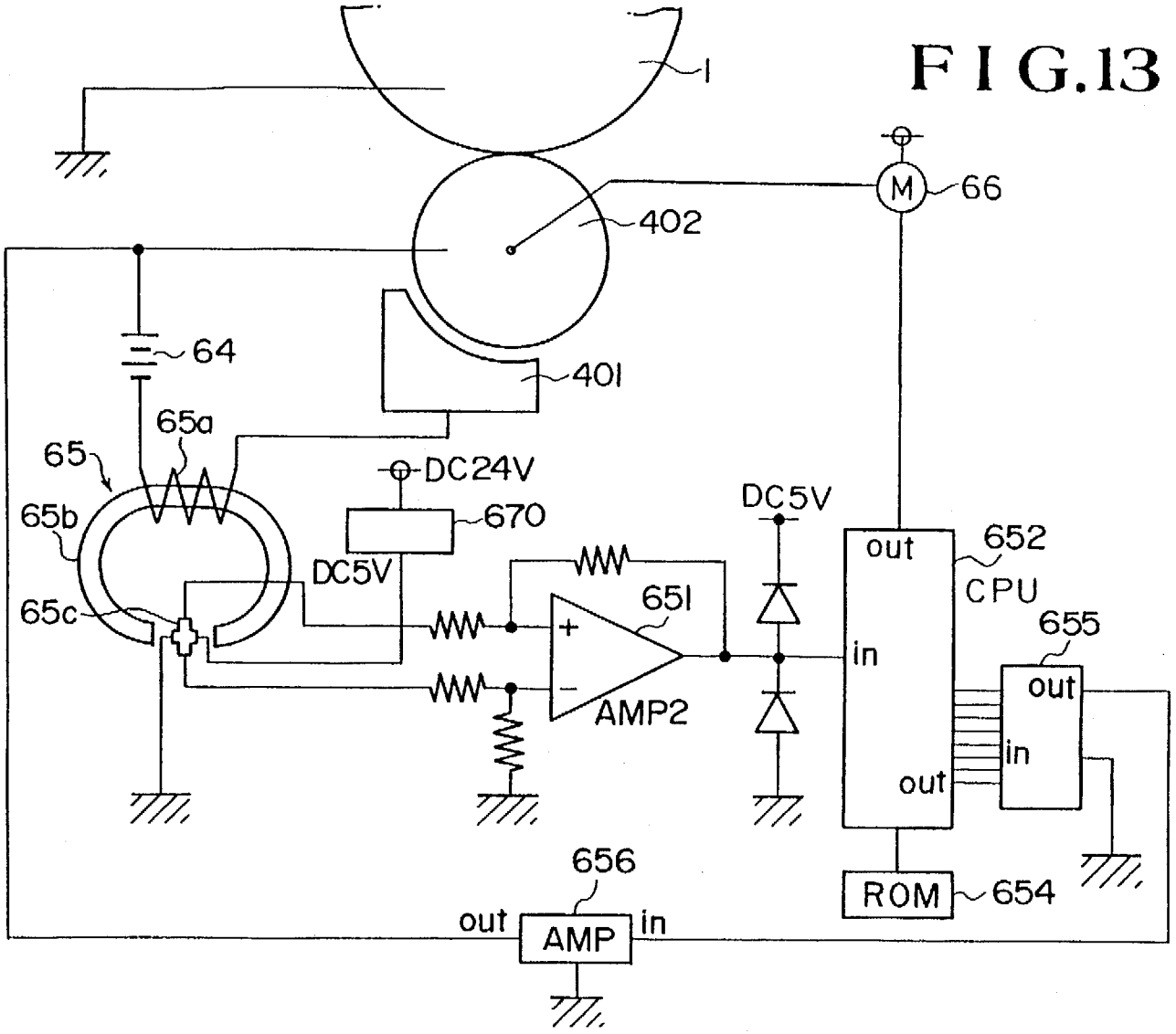
FIG. 13 is a circuit diagram showing a control system for controlling the developing bias based on the results obtained by the liquid developer monitor.

FIG. 12 is a block diagram showing a developing bias controlling system and FIG. 13 is a concrete circuit diagram of the system.

The signal from the electrodeposition current sensor 65 is amplified by the amplifying circuit 651 and then introduced into a comparison circuit 652, specifically a CPU, which incorporates therein an AD converter. The CPU 652 compares the input signal with the standard value by consulting a lookup table on an ROM 654. Based on the result of this comparison, the CPU 652 injects a relevant signal via the DA converter 655 into a developing bias amplifying circuit 656. The amplifying circuit 656 generates a voltage corresponding to the input signal and applies it to the developing roller 402. Thus, the developing bias is adjusted.

This adjustment of the developing bias is so implemented that, for example, when the magnitude of the electrodeposition current exceeds the standard value by a large margin, the magnitude of electric charge put on the toner in the liquid developer is judged to be unduly large and the absolute value of the developing bias is decreased.

Incidentally, the electrodeposition current sensor 65, the power source 64, the amplifying circuit 651, the CPU 652, and other components involved herein are the same as those described above in Example 1.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. A liquid developer monitoring device comprising:

(a) an electrode for contacting a liquid developer comprising a liquid medium and electrically charged toner particles dispersed therein;

(b) an electrically conductive roller which is immersed in the liquid developer;

(c) an electric power source which applies a bias voltage between said electrode and said roller so as to deposit the toner particles on the roller;

(d) a sensor which measures magnitude of current flowing between said electrode and said roller during the deposition of toner particles; and (e) a remover which removes toner particles deposited on the roller so as to provide a fresh surface on the roller.

2. The monitoring device as claimed in claim 1 wherein said power source applies at least one kind of voltage selected from the group consisting of direct current voltage, alternating current voltage overlaid on direct current voltage, and pulse voltage overlaid on direct current voltage.

3. The monitoring device as claimed in claim 1 wherein said toner particles have average particle diameter of 0.5 to 5.0 μm.

4. The monitoring device as claimed in claim 1 wherein said liquid developer further comprises a charge controlling agent.

5. The monitoring device as claimed in claim 4 wherein said charge controlling agent comprises a dispersion resin exhibiting solubility to said liquid medium.

6. The monitoring device as claimed in claim 5 wherein said dispersion resin contains a nitrogen atom.

7. A liquid developer monitoring device comprising:

(1) a first electrode for contacting a liquid developer comprising a liquid medium and electrically charged toner particles dispersed therein;

(2) a second electrode which provides a fresh surface and immerses said surface in the liquid developer;

(3) an electric power source which applies a bias voltage between said first and second electrodes so as to deposit toner particles on the second electrode; and (4) a sensor which measures magnitude of current flowing between said first and second electrodes during the deposition of the toner particles, wherein said sensor comprises:

(a) an electric coil connected with said first and second electrodes;

(b) a magnet inserted in said coil, both ends of said magnet confronting each other; and (c) a Hall element disposed in the magnet confrontation area.

8. The monitoring device as claimed in claim 7 which further comprises, a remover which removes toner particles deposited on the second electrode so as to provide a fresh surface on the second electrode.

9. The monitoring device as claimed in claim 8 wherein said second electrode is an electrically conductive roller.

10. A liquid developer controlling system comprising:

(a) an electrode for contacting a liquid developer comprising a liquid medium and electrically charged toner particles dispersed therein;

(b) an electrically conductive roller which is immersed in the liquid developer;

(c) an electric power source which applies a bias voltage between said electrode and said roller so as to deposit said toner particles on the roller;

(d) a sensor which measures magnitude of current flowing between said electrode and said roller during the deposition of the toner particles;

(e) a supplier which supplies a liquid developer component to the liquid developer in response to the current measurement; and (f) a remover which removes toner particles deposited on the roller so as to provide a fresh surface on the roller.

11. The controlling system as claimed in claim 10 wherein said supplier supplies a charged material.

12. The controlling system as claimed in claim 11 wherein said liquid developer further comprises a charge controlling agent and said supplier supplies the charge controlling agent.

13. The controlling system as claimed in claim 12 wherein said supplier supplies a replenishment liquid comprising a liquid medium and a charge controlling agent of higher concentration than the liquid developer.

14. The controlling system as claimed in claim 12 which further comprises:

(a) a second supplier which supplies toner particles; and (b) a third supplier which supplies a liquid medium.

15. The controlling system as claimed in claim 14 wherein said second supplier supplies a replenishment liquid comprising a liquid medium and toner particles of higher toner concentration than the liquid developer.

16. The controlling system as claimed in claim 12 which controls the amount of charge controlling agent in the range of 0.1 to 5.0 percent by weight relative to the liquid medium.

17. The controlling system as claimed in claim 11 wherein said supplier supplies charged toner particles.

18. The controlling system as claimed in claim 10 wherein said supplier supplies a liquid developer component so that the liquid developer has an volume resistivity of $10^{10}\Omega$.cm or more.

19. An image forming apparatus comprising an image carrying member, a latent image forming device which forms an electrostatic latent image on the image carrying member, a reservoir which accommodates a liquid developer comprising a liquid medium and electrically charged toner particles dispersed therein, a developing device which develops the latent image by the liquid developer, and a liquid developer monitoring device, wherein said liquid monitoring device comprising:

(a) an electrode for contacting liquid developer accommodated in a reservoir;

(b) an electrically conductive roller which is immersed in the liquid developer accommodated in the reservoir;

(c) an electric power source which applies a bias voltage between said electrode and said roller so as to deposit said toner particles on the roller;

(d) a sensor which measures magnitude of current flowing between said electrode and said roller during the deposition of the toner particles; and (e) a remover which removes toner particles deposited on the roller so as to provide a fresh surface on the roller.

20. The image forming apparatus as claimed in claim 19 wherein said developing device includes said reservoir and said monitoring device therein, and said roller serves as a developing member which develops the latent image by contacting the liquid developer carried thereon with the latent image carrying member.

21. The image forming apparatus as claimed in claim 20 which further comprises a guide which guides the liquid developer removed from the roller so as to avoid direct mixing with the liquid developer accommodated in the reservoir.

22. The image forming apparatus as claimed in claim 20 wherein said developing device has a confrontation area of 3 to 80 mm long between said first and second electrodes.

23. The image forming apparatus as claimed in claim 20 wherein said developing device has a space of 0.1 to 10 mm long between said first and second electrodes.

24. The image forming apparatus as claimed in claim 20 wherein said monitoring device performs the current measurement during the development by the developing device.

25. The image forming apparatus as claimed in claim 20 wherein said power source applies at least one kind of voltage selected from the group consisting of direct current voltage, alternating current voltage overlaid on direct current voltage, and pulse voltage on direct current voltage.

26. The image forming apparatus as claimed in claim 19 which further comprises a supplier which supplies a liquid developer component to the liquid developer accommodated in the reservoir in response to the current measurement by the monitoring device.

27. The image forming apparatus as claimed in claim 26 wherein said liquid developer further comprises a charge controlling agent and said supplier supplies the charge controlling agent.

28. The image forming apparatus as claimed in claim 27 which further comprises:

(a) a second supplier which supplies toner particles; and (b) a third supplier which supplies a liquid medium.

29. The image forming apparatus as claimed in claim 19, which further comprises, a controlling device for controlling a condition for image formation in response to the current measurement by the monitoring device.

30. The image forming apparatus as claimed in claim 29 wherein said condition for image formation is at least one condition selected from the group consisting of development bias voltage, surface potential of the image carrying member, and electrodeposition bias voltage.

31. The image forming apparatus as claimed in claim 29, wherein said image forming device comprises:

(a) an electric charger which uniformly charges a surface of the image carrying member; and (b) an irradiator which irradiates the charged surface of the image carrying member so as to form an electrostatic latent image on the image carrying member, wherein said controlling device controls generating power of said irradiator.

32. The image forming apparatus as claimed in claim 21, which further comprises, a circulator, wherein said circulator supplies a liquid developer accommodated in the reservoir to the confrontation area between the electrode and the roller at a predetermined flow rate and returns the developer flowing from the confrontation area to the reservoir, and wherein said controlling device controls flow rate of the circulator.

* * * * *